US009724917B2

(12) United States Patent
Yasoshima et al.

(10) Patent No.: US 9,724,917 B2
(45) Date of Patent: Aug. 8, 2017

(54) MEMS DEVICE, LIQUID EJECTING HEAD, AND LIQUID EJECTING APPARATUS

(71) Applicant: SEIKO EPSON CORPORATION, Tokyo (JP)

(72) Inventors: Takeshi Yasoshima, Matsumoto (JP); Takahiro Kamijo, Matsumoto (JP); Koji Aruga, Suwa-gun (JP); Masanori Mikoshiba, Suwa-gun (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/049,458

(22) Filed: Feb. 22, 2016

(65) Prior Publication Data

US 2016/0263886 A1 Sep. 15, 2016

(30) Foreign Application Priority Data

Mar. 13, 2015 (JP) ..... 2015-051211

(51) Int. Cl.
*B41J 2/14* (2006.01)

(52) U.S. Cl.
CPC ..... *B41J 2/14* (2013.01); *B41J 2/14233* (2013.01); *B41J 2002/14362* (2013.01); *B41J 2002/14491* (2013.01)

(58) Field of Classification Search
CPC ..... B41J 2002/14491; B41J 2/14072; B41J 2/04521; B41J 2/14201; B41J 2/14233
See application file for complete search history.

(56) References Cited

U.S. PATENT DOCUMENTS 6,886,923 B2 5/2005 Miyata
2006/0017779 A1* 1/2006 Ito ..... B41J 2/14209 347/50

FOREIGN PATENT DOCUMENTS

JP 2003-211658 A 7/2003
JP 2004-017600 A 1/2004
JP EP1375150 A 1/2004

* cited by examiner

*Primary Examiner* — Geoffrey Mruk
(74) *Attorney, Agent, or Firm* — Workman Nydegger

(57) ABSTRACT

A MEMS device includes a protective substrate on which is mounted a driving circuit that drives a piezoelectric actuator and on which is formed an interconnect pattern electrically connected to the driving circuit, and a sealing substrate that includes a first opening and that is bonded to the protective substrate using an adhesive so that part of the interconnect pattern is located between the protective substrate and the sealing substrate. The interconnect pattern includes a connection portion that extends from a bonding region where the protective substrate and the sealing substrate are bonded by the adhesive to the first opening, and that has a connection region electrically connected to the driving circuit. A groove is formed in the connection portion between the connection region and a border between the bonding region and the connection portion.

13 Claims, 9 Drawing Sheets

MEMS DEVICE, LIQUID EJECTING HEAD, AND LIQUID EJECTING APPARATUS

BACKGROUND

1. Technical Field

The present invention relates to MEMS devices, liquid ejecting heads, and liquid ejecting apparatuses, and particularly relates to ink jet recording heads and ink jet recording apparatuses that eject ink as a liquid.

2. Related Art

There is a liquid ejecting head, which is an example of a device including a MEMS (Micro Electro Mechanical Systems) device, that includes a flow channel formation substrate in which pressure generation chambers communicating with corresponding nozzle openings that eject a liquid are formed, piezoelectric actuators provided on one surface side of the flow channel formation substrate, a protective substrate bonded to the piezoelectric actuator side of the flow channel formation substrate, a driving circuit that drives the piezoelectric actuators, and a manifold that serves as a common liquid chamber for the pressure generation chambers.

The driving circuit is disposed on one surface of the protective substrate (called an "installation surface" hereinafter), and a terminal portion of the driving circuit is electrically connected to the piezoelectric actuators by bonding wires. Meanwhile, an interconnect pattern connected to external wiring such as an FPC or the like is formed on the installation surface of the protective substrate, and the interconnect pattern and the driving circuit are electrically connected by bonding wires.

The manifold is open on the installation surface side of the protective substrate, and that opening is sealed by a flexible compliance portion of a sealing substrate. This sealing substrate is bonded to a region of the installation surface where the interconnect pattern is not provided (for example, see JP-A-2004-17600).

In such a liquid ejecting head, the liquid is supplied to the manifold from an external liquid supply source, and the liquid is then supplied from the manifold to the respective pressure generation chambers. Predetermined driving waveforms are then applied to the piezoelectric actuators from the driving circuit, and the liquid within the pressure generation chambers is pressurized and ejected from the nozzle openings. Meanwhile, the compliance portion deforms so as to absorb pressure changes in the liquid within the manifold, and thus the pressure of the liquid within the manifold can be kept constant.

Here, if the sealing substrate is to be bonded to the protective substrate while avoiding the interconnect pattern, it is necessary to secure a region for the sealing substrate to be bonded to the protective substrate, which increases the size of the liquid ejecting head in a planar direction. Accordingly, a configuration can be considered in which, when viewed in plan view, both ends of the interconnect pattern to which the external wiring, bonding wires, or the like are connected are exposed, and the sealing substrate is bonded to the protective substrate so that the sealing substrate overlaps with the other regions. According to this configuration, part of the interconnect pattern can also function as a region to which the sealing substrate is bonded, and thus the bonding region of the protective substrate can be reduced in size, making it possible to reduce the size in the planar direction.

However, there is a risk that adhesive will enter into the interconnect pattern, the periphery thereof, and so on from between the sealing substrate and the protective substrate and reach the region where the bonding wires of the interconnect pattern are connected. If that region is covered by adhesive, there is a risk that the bonding wires can no longer be electrically connected and the piezoelectric actuator can no longer be driven correctly.

It should be noted that this problem is not limited to liquid ejecting heads that eject liquid, and also arises in the same manner in other MEMS devices aside from liquid ejecting heads.

SUMMARY

An advantage of some aspects of the invention is to provide a MEMS device capable of driving a pressure generating unit with a more secure connection between a driving circuit and an interconnect pattern, and a liquid ejecting head and liquid ejecting apparatus capable of ejecting a liquid in a reliable manner.

A MEMS device according to an aspect of the invention includes a protective substrate on which is mounted a driving circuit that drives a pressure generating unit and on which is formed an interconnect pattern electrically connected to the driving circuit, and a sealing substrate that includes an opening and that is bonded to the protective substrate using an adhesive so that part of the interconnect pattern is located between the protective substrate and the sealing substrate; the interconnect pattern has a connection portion that extends from a region where the protective substrate and the sealing substrate are bonded by the adhesive to the opening, and that has a connection region electrically connected to the driving circuit, and a groove is formed in the connection portion between the connection region and a border between the region and the connection portion.

According to this aspect, the adhesive that bonds the sealing substrate can be suppressed from advancing into the connection region. Accordingly, it is possible to suppress the electrical connection between the interconnect pattern and the driving circuit from being interfered with by the adhesive. This makes it possible to supply a driving signal to the driving circuit over a more secure electrical connection between the interconnect pattern and the driving circuit and drive the pressure generating unit. Meanwhile, part of the interconnect pattern also functions as a bonding region to which the sealing substrate is bonded, which makes it possible to reduce the size of the bonding region on the protective substrate in the planar direction and miniaturize the MEMS device as well.

Here, it is preferable that the groove be formed so as to partially surround the connection region and be conductive with the connection portion on the side of the connection region opposite from the border. According to this configuration, the groove is provided in the location where it is least likely that the adhesive will reach the connection region, and thus the adhesive can be suppressed from entering into the connection region with more certainty.

In addition, it is preferable that the connection portion have a linear portion provided between the border and the connection region, and a branching portion that branches from the linear portion. According to this configuration, it is less likely that the adhesive will surround all of the peripheral edges of the connection portion, which makes it possible to suppress the adhesive from overflowing onto the connection portion and reaching the connection region.

In addition, it is preferable that in adjacent connection portions, the branching portion of one of the connection portions and the branching portion of another of the connection portions overlap in a direction progressing from the border toward the connection region. According to this configuration, the width occupied by adjacent connection portions can be narrowed, which makes it possible to reduce the size, in the planar direction, of the protective substrate on which the connection portions are provided, and furthermore miniaturize the MEMS device as well.

A MEMS device according to another aspect of the invention includes a protective substrate on which is mounted a driving circuit that drives a pressure generating unit and on which is formed an interconnect pattern electrically connected to the driving circuit, and a sealing substrate that includes an opening and that is bonded to the protective substrate using an adhesive so that part of the interconnect pattern is located between the protective substrate and the sealing substrate; the interconnect pattern has a connection portion that extends from a region where the protective substrate and the sealing substrate are bonded by the adhesive to the opening, and that has a connection region electrically connected to the driving circuit, and the connection portion has a linear portion provided between the border and the connection region, and a branching portion that branches from the linear portion.

According to this configuration, it is less likely that the adhesive will surround all of the peripheral edges of the connection portion, which makes it possible to suppress the adhesive from overflowing onto the connection portion and reaching the connection region. This makes it possible to ensure a more secure electrical connection between the driving circuit and the interconnect pattern over which to supply a driving signal to the driving circuit and drive the pressure generating unit. Meanwhile, part of the interconnect pattern also functions as a bonding region to which the sealing substrate is bonded, which makes it possible to reduce the size of the bonding region on the protective substrate in the planar direction and miniaturize the MEMS device as well.

A liquid ejecting head according to another aspect of the invention includes the aforementioned MEMS device and a flow channel formation substrate in which a pressure generation chamber that communicates with a nozzle opening that ejects a liquid is provided; the pressure generating unit is provided on one surface of the flow channel formation substrate and generates a change in pressure in the liquid in the pressure generation chamber. According to this aspect, the adhesive that bonds the sealing substrate can be suppressed from advancing into the connection region. Accordingly, it is possible to suppress the electrical connection between the interconnect pattern and the driving circuit from being interfered with by the adhesive. Through this, a liquid ejecting head in which a driving signal can be supplied to the driving circuit over a more secure electrical connection between the interconnect pattern and the driving circuit, and that is capable of driving the pressure generating unit and ejecting the liquid in a reliable manner, is provided. Meanwhile, part of the interconnect pattern also functions as a bonding region to which the sealing substrate is bonded, which makes it possible to reduce the size of the bonding region on the protective substrate in the planar direction and miniaturize the liquid ejecting head as well.

Here, it is preferable that the protective substrate be provided on the one surface of the flow channel formation substrate, and that a space that allows the pressure generating unit to bend be formed in the protective substrate. According to this configuration, the protective substrate, in which is provided the interconnect pattern connected to the driving circuit, also functions as a member for protecting the pressure generating unit provided in the flow channel formation substrate, which makes it possible to reduce component costs.

A liquid ejecting apparatus according to another aspect of the invention includes the aforementioned liquid ejecting head. According to this configuration, a liquid ejecting apparatus in which the driving circuit and the interconnect pattern are connected more securely, and that is capable of reliably ejecting a liquid, is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

The invention will be described in detail based on embodiments. An ink jet recording head will be given as an example of a liquid ejecting head, and may also be called simply a "recording head". An ink jet recording apparatus will be given as an example of a liquid ejecting apparatus.

Figure 1:
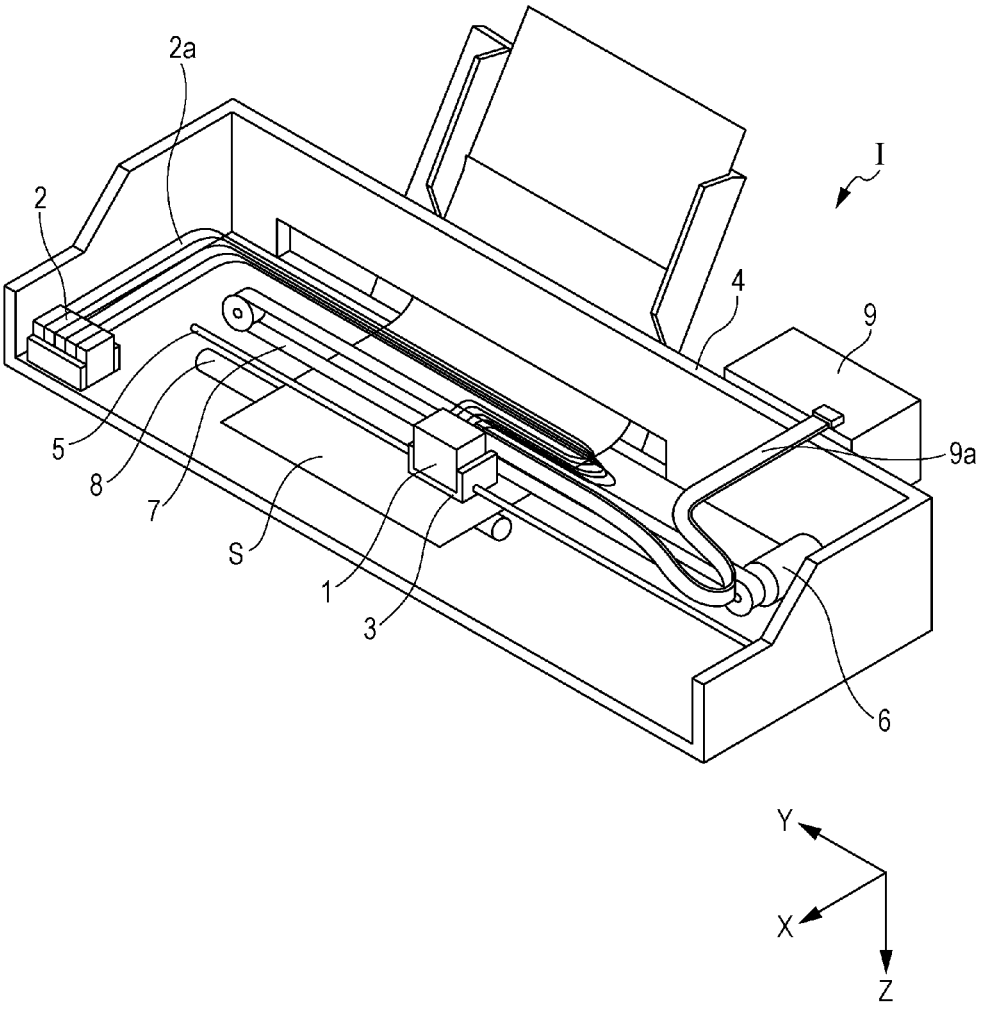
FIG. 1 is a schematic diagram illustrating an ink jet recording apparatus.

FIG. 1 is a schematic diagram illustrating an ink jet recording apparatus according to the invention. In an ink jet recording apparatus I, an ink jet recording head unit 1 (also called a "head unit 1" hereinafter) is mounted in a carriage 3. The carriage 3 in which the head unit 1 is mounted is provided so as to be mobile in the axial direction of a carriage shaft 5 attached to an apparatus main body 4.

Liquid holding units 2 constituted by ink tanks or the like that hold ink are provided in the apparatus main body 4, and ink from the liquid holding units 2 is supplied to the head unit 1 mounted in the carriage 3 via supply pipes 2*a* such as tubes or the like. Note that in this embodiment, five different inks are held in respective liquid holding units 2.

Transmitting driving force generated by a driving motor 6 to the carriage 3 via a plurality of gears (not shown) and a timing belt 7 moves the carriage 3, in which the head unit 1 is mounted, along the carriage shaft 5. Meanwhile, a transport roller 8 serving as a transport unit is provided in the apparatus main body 4, and an ejection target medium S such as paper or the like is transported by the transport roller 8. Note that the transport unit that transports the ejection target medium S is not limited to a transport roller, and may be a belt, a drum, or the like.

In addition, a control device 9 serving as a control unit that controls operations of the ink jet recording apparatus I is provided in the ink jet recording apparatus I. The control device 9 is connected to a driving circuit 120 of a recording head 220, which will be mentioned later, by external wiring 9*a* such as an FPC or the like. The control device 9 supplies driving signals and driving voltages to the driving circuit 120 through the external wiring 9*a*.

In this embodiment, a transport direction of the ejection target medium S is called a first direction X, and a movement direction of the carriage 3 is called a second direction Y. Meanwhile, an ejection direction of ink droplets from the head unit 1 is called a third direction Z. Although this embodiment describes the first direction X, the second direction Y, and the third direction Z as being orthogonal to one another, the directions are not particularly limited thereto, and may be directions that intersect without being orthogonal to one another. The coordinate axes illustrated in FIG. 1 represent the first direction X, the second direction Y, and the third direction Z, with the directions the arrows face being positive (+) directions and the directions opposite thereto being negative (−) directions. The same applies to the arrows in FIG. 2 and on.

Figure 2:
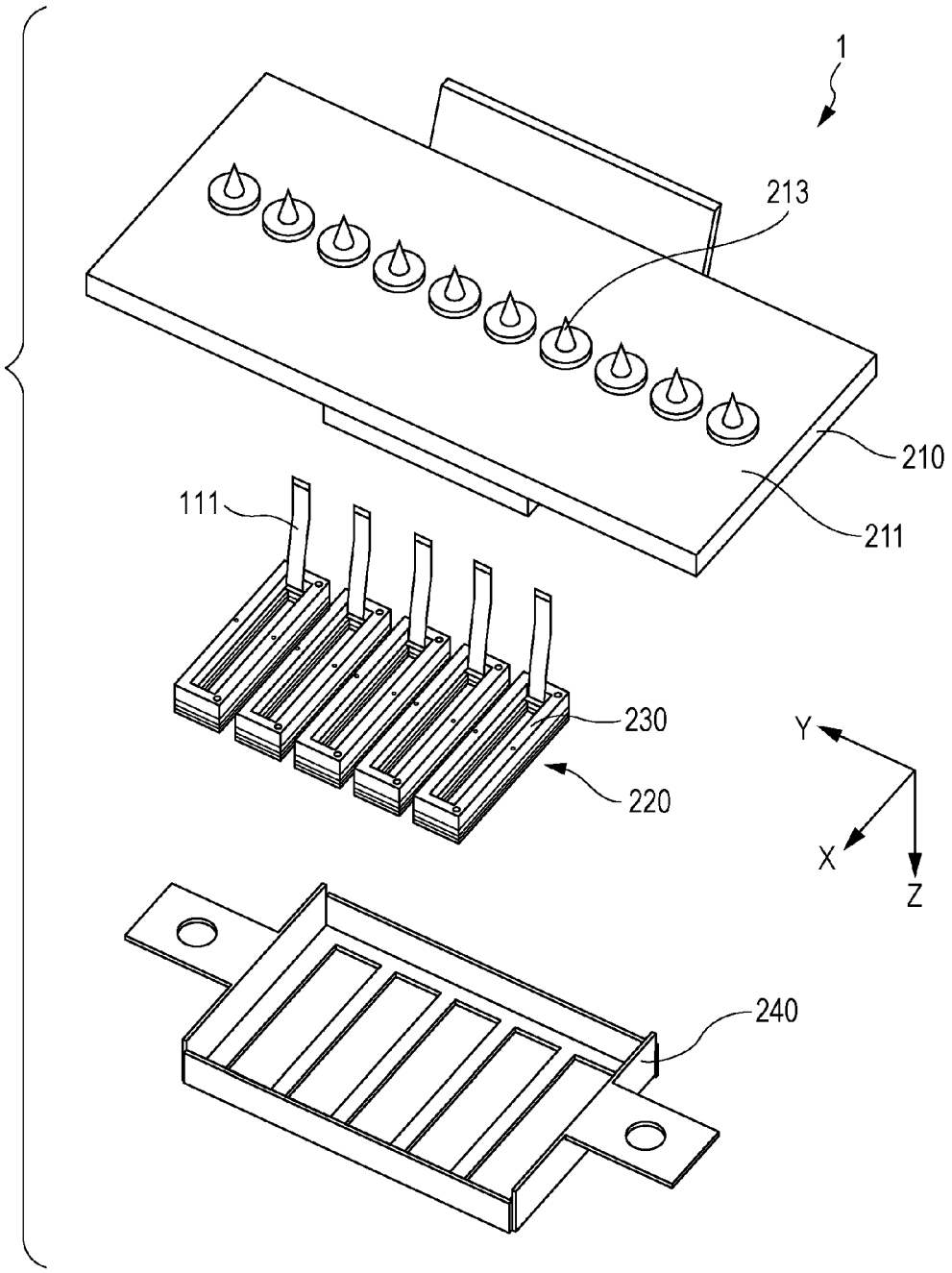
FIG. 2 is an exploded perspective view of a head unit.
Figure 3:
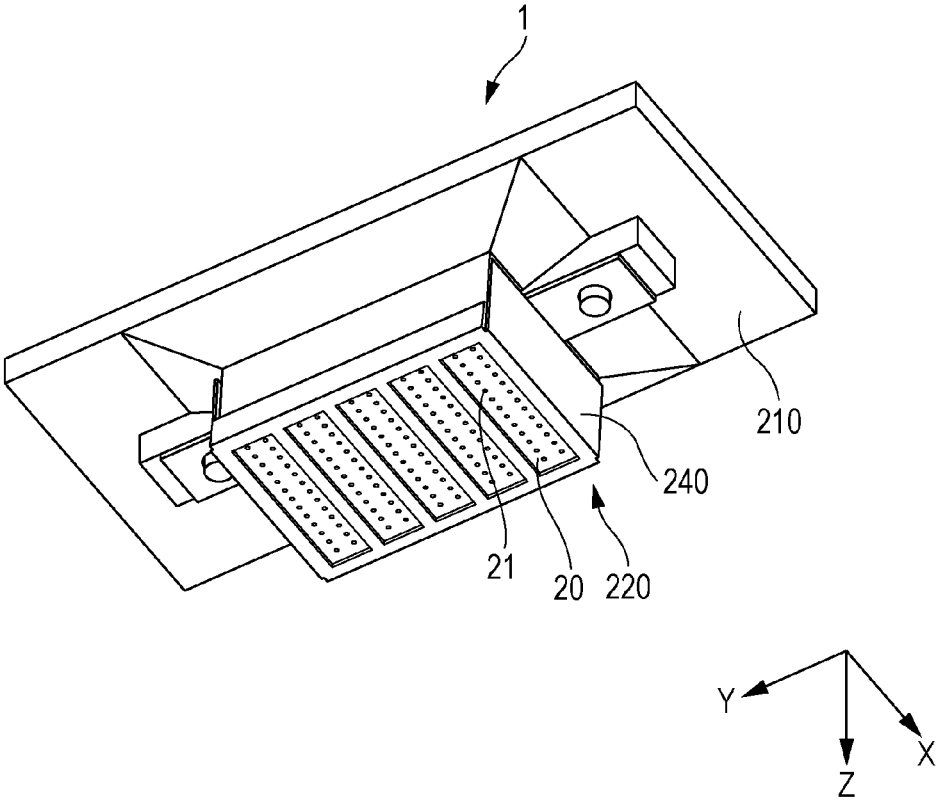
FIG. 3 is a perspective view of a head unit.
Figure 4:
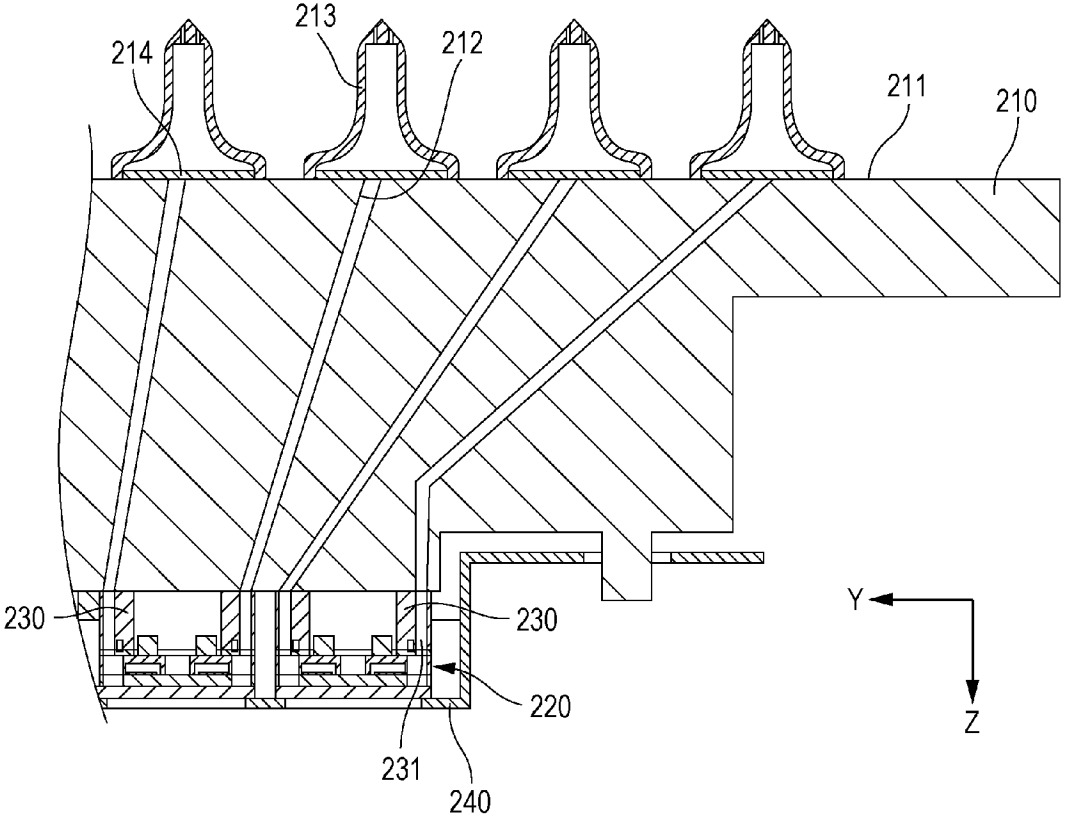
FIG. 4 is a cross-sectional view of a head unit.

An example of the head unit 1 will be described with reference to FIGS. 2 through 4. FIG. 2 is an exploded perspective view of the head unit, FIG. 3 is a perspective view of the head unit, and FIG. 4 is a cross-sectional view of the head unit.

The head unit 1 includes a flow channel member 210, a plurality of recording heads 220 held by the flow channel member 210, head cases 230, and a cover head 240.

The flow channel member 210 has a connection portion 211 connected directly or via a pressure adjustment unit or the like to the supply pipes 2*a* of the liquid holding units 2. In addition, a plurality of first ink communication channels 212 that open into the connection portion 211 at one end and are open in the flow channel member 210 on the opposite side from the connection portion 211 at the other end, are provided in the flow channel member 210. Furthermore, an ink supply pin 213, to which a corresponding supply pipe 2*a* is connected directly or via a pressure adjustment unit or the like, is affixed at the opening of a corresponding first ink communication channel 212 in the connection portion 211, with a filter 214 that removes foreign objects such as bubbles, particles, or the like in the ink.

In addition, a plurality of recording heads 220, namely five in this embodiment, are affixed to the side of the flow channel member 210 opposite from the connection portion 211 in the third direction Z (that is, to a +Z-side surface), and ink supplied from the ink supply pins 213 via the first ink communication channels 212 is supplied to corresponding recording heads 220. Here, an arrangement direction of the recording heads 220 is set to match the second direction Y when the head unit 1 is mounted in the aforementioned ink jet recording apparatus I. Accordingly, the following assumes that when referring to the recording heads 220 and the head unit 1, the first direction X and the second direction Y are directions based on the directions in which those elements are mounted in the ink jet recording apparatus I.

These recording heads 220 are affixed to the flow channel member 210, with the corresponding head cases 230 provided therebetween, on the sides of the recording heads 220 that are opposite from liquid ejecting surfaces 20*a* in the third direction Z (that is, a −Z-side surface). The liquid ejecting surface 20*a* side of the recording heads 220 is covered by the cover head 240 that exposes nozzle openings 21, and the cover head 240 is affixed to the flow channel member 210.

Second ink communication channels 231 for supplying the liquid to a corresponding recording head 220, described later, are provided in each head case 230. The second ink communication channels 231 communicates with corresponding first ink communication channels 212 of the flow channel member 210. Note that a resin, a metal, or the like, for example, can be used as the material of the head case 230.

Figure 5:
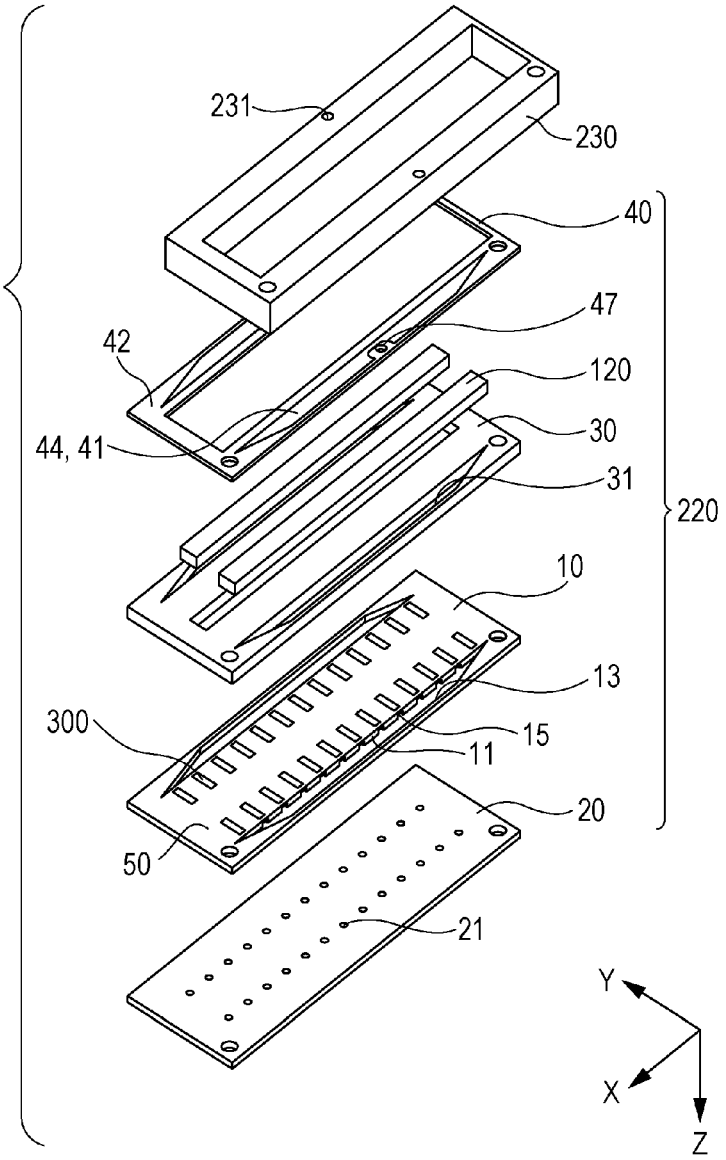
FIG. 5 is an exploded perspective view of a recording head.
Figure 7A:
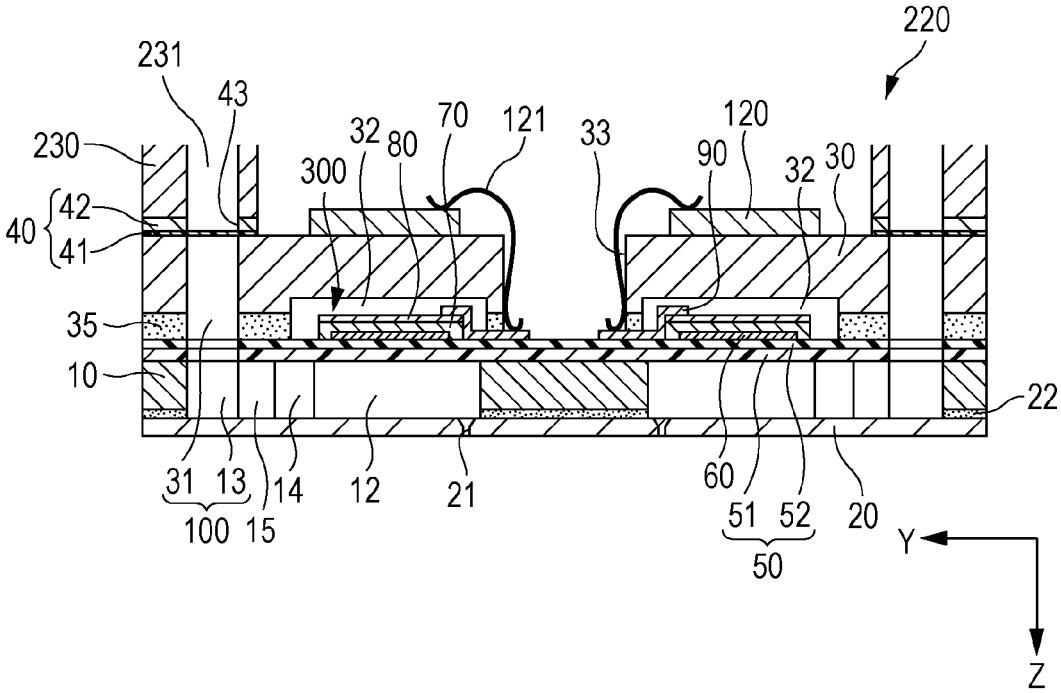
FIGS. 7A and 7B are cross-sections viewed along a VII-VII line illustrated in FIG. 6.
Figure 7B:
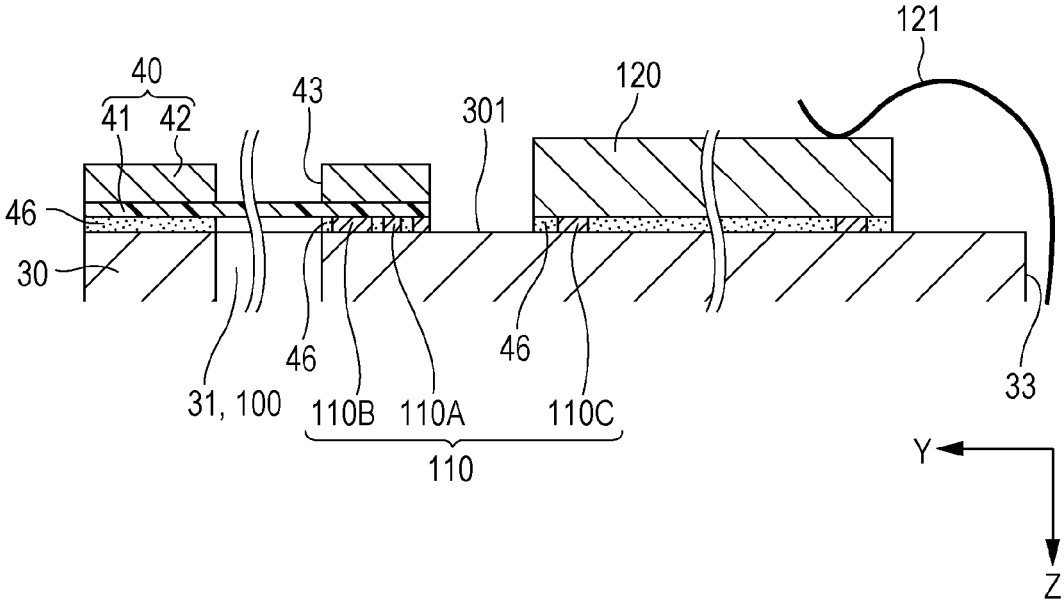
Figure 8:
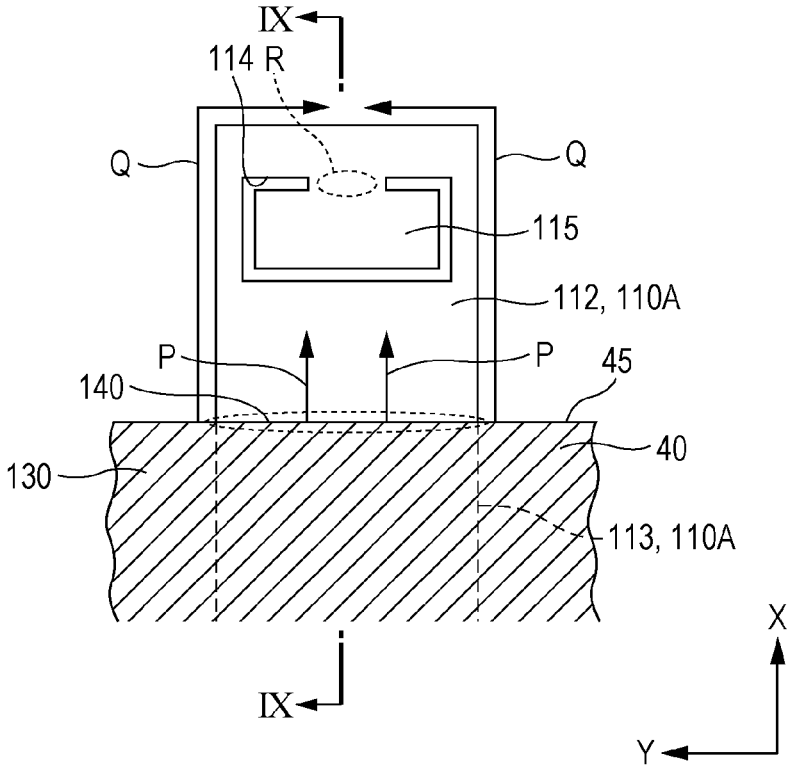
FIG. 8 is a plan view illustrating the enlarged vicinity of a connection portion of an interconnect pattern.
Figure 9:
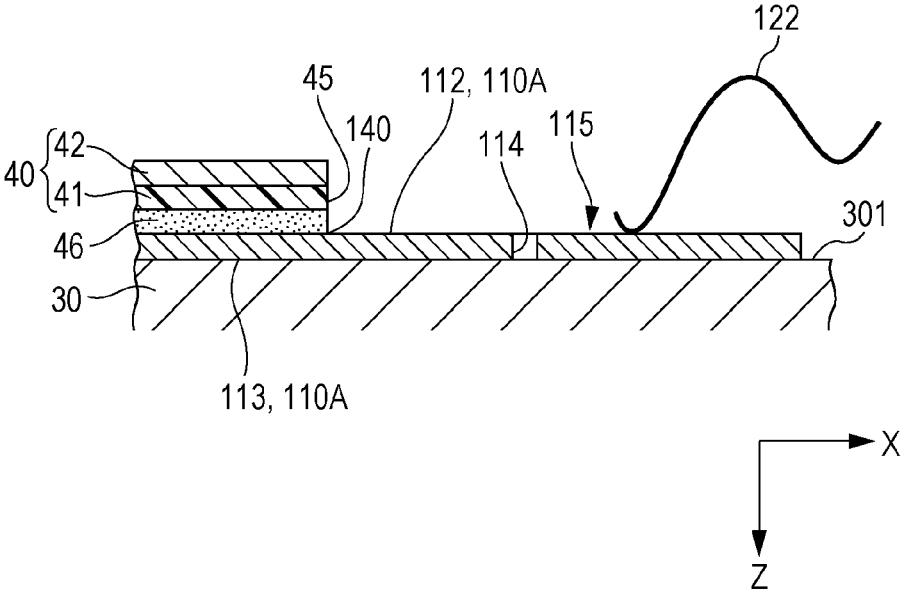
FIG. 9 is a cross-section viewed along a IX-IX line illustrated in FIG. 8.

The recording head 220 according to this embodiment will now be described using FIGS. 5 to 9. FIG. 5 is an exploded perspective view of the recording head, FIG. 6 is a plan view of the recording head, FIGS. 7A and 7B are cross-sections viewed along a VII-VII line illustrated in FIG. 6, FIG. 8 is a plan view illustrating the enlarged vicinity of a connection portion of an interconnect pattern, and FIG. 9 is a cross-section viewed along a IX-IX line illustrated in FIG. 8.

Figure 6:
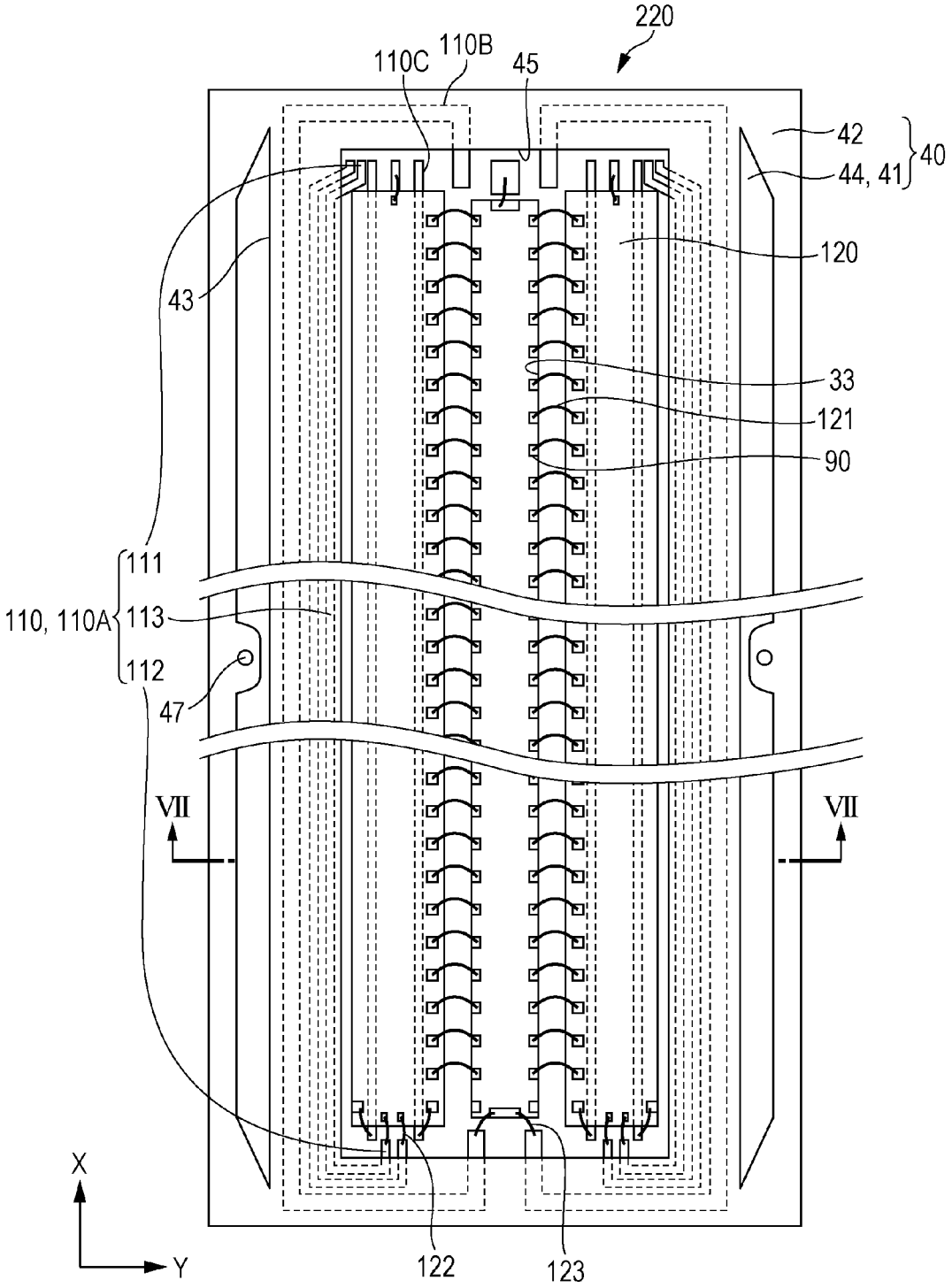
FIG. 6 is a plan view of a recording head.

As illustrated in FIGS. 5 to 7, the recording head 220 according to this embodiment includes a plurality of members, such as a flow channel formation substrate 10, a piezoelectric actuator 300, a protective substrate 30, a sealing substrate 40, and so on. In this embodiment, a configuration constituted by the protective substrate 30 on which the driving circuit 120 that drives the piezoelectric actuator 300 is mounted and on which an interconnect pattern 110 is formed, and the sealing substrate 40 bonded to the protective substrate 30 using an adhesive 46 corresponds to a MEMS device according to the aspects of the invention.

Pressure generation chambers 12 defined by a plurality of partitions 11 are arranged along the first direction X in the flow channel formation substrate 10 that constitutes the recording head 220. In this embodiment, two columns of the pressure generation chambers 12, which are arranged in the first direction X, are provided in the second direction Y.

A communication portion 13 is formed on one side end, in the second direction Y, of the pressure generation chambers 12 of the flow channel formation substrate 10, and the communication portion 13 and pressure generation chambers 12 communicate with each other via ink supply channels 14 and communication channels 15 provided for each of the pressure generation chambers 12. The communication portion 13 communicates with a manifold portion 31 of the protective substrate 30, which will be described later, and constitutes part of a manifold that serves as a common ink chamber for a corresponding column of the pressure generation chambers 12. Note that the ink supply channels 14 are formed so as to be narrower than the pressure generation chambers 12 in the first direction X, and thus maintain the flow channel resistance for the ink that flows from the communication portion 13 into the pressure generation chambers 12 at a constant value. However, although the ink supply channels 14 are formed so that the width of the flow channel narrows from one side in the first direction X in this embodiment, it should be noted that the ink supply channels may be formed so that the width of the flow channel narrows from both sides. Furthermore, the width of the flow channel need not be narrowed, and the ink supply channels may instead be formed so as to narrow in the thickness direction. Furthermore, the communication channels 15 are formed by extending the partitions of the pressure generation chambers 12 on both sides thereof in the first direction X toward the communication portion 13 side and defining spaces between the ink supply channels 14 and the communication portion 13. In other words, the ink supply channels 14 that have smaller cross-sectional areas than the cross-sectional areas of the pressure generation chambers 12 in the width direction thereof, and the communication channels 15 that communicate with the ink supply channels 14 and have greater cross-sectional areas than the cross-sectional areas of the ink supply channels 14 in the width direction thereof, are provided in the flow channel formation substrate 10 by being defined by the plurality of partitions 11.

A nozzle plate 20 in which the nozzle openings 21 that communicate with corresponding pressure generation chambers 12 are provided is bonded, using an adhesive 22, to one surface side (the +Z-side surface) of the flow channel formation substrate 10, or in other words, to a surface on which the liquid flow channels including the pressure generation chambers 12 and the like are open. In other words, two columns of the nozzle openings 21, which are arranged in the first direction X, are provided in the nozzle plate 20 in the second direction Y. For example, glass ceramics, a silicon single-crystal substrate, a metal material such as stainless steel, or the like can be used as the nozzle plate 20.

A vibration plate 50 is formed on another surface side (the −Z-side surface) of the flow channel formation substrate 10. The vibration plate 50 according to this embodiment is constituted by an elastic film 51 formed on the flow channel formation substrate 10, and an insulator film 52 formed on the elastic film 51. Note that the liquid flow channels including the pressure generation chambers 12 and the like are formed through anisotropic etching from one surface of the flow channel formation substrate 10, and the vibration plate 50 (the elastic film 51) configures the other surface of the liquid flow channels including the pressure generation chambers 12 and the like.

Meanwhile, the piezoelectric actuator 300, which is an example of a pressure generating unit, is provided on the vibration plate 50. In this embodiment, a first electrode 60, a piezoelectric material layer 70, and a second electrode 80 are formed through deposition and lithography, and constitute the piezoelectric actuator 300. Here, "piezoelectric actuator 300" refers to the portion that includes the first electrode 60, the piezoelectric material layer 70, and the second electrode 80. Generally speaking, one of the electrodes in the piezoelectric actuator 300 serves as a common electrode, whereas the other electrode and the piezoelectric material layer 70 are formed through patterning carried out for each of the pressure generation chambers 12. Furthermore, here, the portion constituted by one of the electrodes obtained through patterning and the piezoelectric material layer 70, and in which piezo electrostriction occurs when a voltage is applied to the two electrodes, is referred to as a "piezoelectric functional portion". In this embodiment, the first electrode 60 serves as the common electrode for each piezoelectric actuator 300 and the second electrode 80 serves as an individual electrode for the piezoelectric actuator 300; however, this may be reversed with no ill effects if required by a driving circuit, wiring pattern, and so on. Although the elastic film 51, the insulator film 52, and the first electrode 60 act as the vibration plate in the stated example, it should be noted that the invention is of course not limited thereto; for example, only one of the elastic film 51 and the insulator film 52 may be provided as the vibration plate 50, or the first electrode 60 alone may be provided as the vibration plate without providing the elastic film 51 and insulator film 52. Furthermore, the piezoelectric actuator 300 itself may essentially play the role of the vibration plate as well.

The piezoelectric material layer 70 is a perovskite-structure crystal film (a perovskite type crystal) constituted by a ferroelectric ceramic material exhibiting an electromechanical transduction effect and formed on the first electrode 60. A ferroelectric piezoelectric material such as lead zirconate titanate (PZT), a material obtained by adding a metal oxide such as niobium oxide, nickel oxide, magnesium oxide, or the like thereto, or the like can be used as the material of the piezoelectric material layer 70. The material of the piezoelectric material layer 70 is not limited to a lead-based piezoelectric material containing lead, and a lead-free piezoelectric material, which does not contain lead, can be used as well.

A lead electrode 90 formed from gold (Au), for example, that is led out from the vicinity of an end portion on the ink supply channel 14 side and extended to an area above the insulator film 52, is connected to each second electrode 80, which serves as the individual electrode for its corresponding piezoelectric actuator 300.

The protective substrate 30 is bonded, using an adhesive 35, to the top of the flow channel formation substrate 10 in which the piezoelectric actuators 300 are formed, or in other words, is bonded upon the first electrode 60, the vibration plate 50, and the lead electrodes 90.

A holding portion 32, having a space of a size that allows bending of the piezoelectric actuators 300, is provided in a region of the protective substrate 30 that opposes the piezoelectric actuators 300. The holding portion 32 may have a space of any size as long as the space allows bending of the piezoelectric actuators 300, and the space may or may not be sealed.

It is preferable to use a material having essentially the same coefficient of thermal expansion as the flow channel formation substrate 10, such as glass, a ceramic material, or the like as the protective substrate 30; in this embodiment, the protective substrate 30 is formed using the same type of silicon single-crystal substrate as the flow channel formation substrate 10.

Furthermore, the protective substrate 30 has the manifold portion 31, which constitutes at least part of a manifold 100. The manifold portion 31 is in this embodiment formed passing through the protective substrate 30 in the thickness direction thereof and spanning in the width direction of the pressure generation chambers 12 (the first direction X). The manifold portion 31 communicates with the aforementioned communication portion 13 of the flow channel formation substrate 10, and constitutes the manifold 100, which serves as a common ink chamber for the pressure generation chambers 12.

Note that the communication portion 13 of the flow channel formation substrate 10 may be divided into a plurality of parts corresponding to the pressure generation chambers 12, and the manifold portion 31 alone may serve as the manifold. Furthermore, for example, it is also possible to provide only the pressure generation chambers 12 in the flow channel formation substrate 10, and provide the ink supply channels 14 that enable the pressure generation chambers 12 to communicate with the manifold in a member interposed between the flow channel formation substrate 10 and the protective substrate 30 (the elastic film 51, the insulator film 52, or the like, for example).

Meanwhile, a through-hole 33 that passes through the protective substrate 30 in the thickness direction thereof is provided in the protective substrate 30. The vicinities of the ends of the lead electrodes 90, which are led out from their corresponding piezoelectric actuators 300, are provided so as to be exposed within the through-hole 33.

A surface of the protective substrate 30 on the opposite side from the side on which the piezoelectric actuators 300 are located is called an installation surface 301. The driving circuit 120 for driving the piezoelectric actuators 300 is affixed upon the installation surface 301. The driving circuit 120 is a circuit that forms driving signals for driving the piezoelectric actuators 300 and is capable of transmitting those driving signals to the piezoelectric actuators 300, but is not limited to such a form. The driving circuit may be this type of active circuit that forms driving signals, or may be a circuit formed from wiring that transmits driving signals from an external control unit or the like to the piezoelectric actuators 300.

The driving circuit 120 is electrically connected to the lead electrodes 90 via first connection wires 121, which are formed from conductive wires such as bonding wires.

Meanwhile, a plurality of interconnect patterns 110 are formed on the installation surface 301 of the protective substrate 30. Each interconnect pattern 110 constitutes interconnects for connecting the external wiring 9*a*, which is an FPC or the like, to the driving circuit 120 or the piezoelectric actuators 300.

These interconnect patterns 110 are connected to the control device 9 by the external wiring 9*a*. The configuration is such that driving signals or power is supplied to the driving circuit 120 or the piezoelectric actuators 300 from the control device 9 via the external wiring 9*a* and the interconnect patterns 110. The interconnect patterns 110 can be formed by forming a conductive film such as a metal on the entirety of the installation surface 301 of the protective substrate 30 and then patterning that film, for example. The specific arrangements, shapes, and so on of the interconnect patterns 110 will be described later.

The sealing substrate 40, constituted by a sealing film 41 and an anchoring plate 42, is bonded to the installation surface 301 of the protective substrate 30.

In this embodiment, the anchoring plate 42 has substantially the same outer shape as the protective substrate 30, and is formed having a frame shape in which a first opening 45 is provided in the center thereof. In addition, two second openings 43 that are longer in the first direction X are provided on both sides of the anchoring plate 42 in the second direction Y. The anchoring plate 42 is formed of a hard material such as a metal or the like (for example, stainless steel (SUS) or the like). The first opening 45 is an example of an "opening" according to the aspects of the invention.

The first opening 45 is formed so that the driving circuit 120, part of the interconnect patterns 110, the through-hole 33, and so on provided on the protective substrate 30 are exposed, within the first opening 45. The second opening 43 is provided in a position opposite from the manifold portion 31 in the protective substrate 30. In other words, the second opening 43 is formed by completely removing, in the thickness direction, a region of the anchoring plate 42 that opposes the manifold 100.

The sealing film 41 is provided on the surface of the anchoring plate 42 on the side thereof where the protective substrate 30 is located so as to cover the entire surface of the anchoring plate 42 and the manifold portions 31. The sealing film 41 is formed from a flexible material having a low rigidity (a polyphenylene sulfide (PPS) film, for example).

This sealing substrate 40 is bonded to the installation surface 301 of the protective substrate 30 with the interconnect patterns 110 partially interposed therebetween, using the adhesive 46. In other words, the sealing substrate 40 is bonded to the installation surface 301 of the protective substrate 30 and part of the interconnect patterns 110 using the adhesive 46. The region where the protective substrate 30 and the sealing substrate 40 are bonded using the adhesive 46 corresponds to a "region" according to the aspects of the invention, and will be called a "bonding region" hereinafter. The bonding region includes the region where part of the interconnect patterns 110 formed on the protective substrate 30 and the sealing substrate 40 are bonded together using the adhesive 46.

In this embodiment, the adhesive 46 is provided on the surface of the sealing film 41 on the side thereof that faces the protective substrate 30, aside from the areas that oppose the first opening 45 and the second openings 43 in the anchoring plate 42, and is bonded to the installation surface 301 of the protective substrate 30 and part of the interconnect patterns 110. In other words, the bonding region has the same shape as the planar shape of the anchoring plate 42.

A portion of the sealing film 41 that covers the manifold portion 31 is called a compliance portion 44. The compliance portion 44 seals the opening of the manifold 100 (the opening on the side of the manifold portion 31 on which the installation surface 301 is located). The compliance portion 44 bends in response to fluctuations in the pressure of the liquid in the manifold 100, and thus maintains the pressure of the liquid in the manifold 100 at a constant pressure.

A third ink communication channel 47 is provided in the sealing substrate 40 so as to pass therethrough in the thickness direction (the third direction Z). The third ink communication channel 47 communicates with the manifold 100 and the second ink communication channel 231 provided in the head case 230. Ink is supplied from the second ink communication channel 231 to the manifold 100 via the third ink communication channel 47.

With the recording head 220 according to this embodiment, ink is imported from the aforementioned liquid holding units 2 into the manifold 100, and after the interior spanning from the manifold 100 to the nozzle openings 21 has been filled with ink, voltages are applied between the first electrodes 60 and second electrodes 80 corresponding to the respective pressure generation chambers 12 in accordance with recording signals from the driving circuit 120; the vibration plate 50 and the piezoelectric actuators 300 bend and deform, causing the pressure within the pressure generation chambers 12 to increase and ejecting ink droplets from the nozzle openings 21 as a result.

Next, the interconnect pattern 110 will be described in detail using FIGS. 6 to 9. The interconnect pattern 110 includes a connection portion 112 that extends from a bonding region 130 (the diagonally-hatched area in FIG. 8) to the first opening 45 and includes a connection region 115 electrically connected to the driving circuit 120.

The interconnect pattern 110 extending from the bonding region 130 to the first opening 45 refers to the interconnect pattern 110 being partially interposed between the protective substrate 30 and the sealing substrate 40 through the adhesive 46 and the interconnect pattern 110 being formed so as to be partially exposed within the first opening 45, when viewed in plan view (see FIGS. 6 and 8).

The connection portion 112 refers to a portion of the interconnect pattern 110 that is exposed within the first opening 45 and has the connection region 115 that is electrically connected to the driving circuit 120. The connection region 115 is a portion of the connection portion 112 that is electrically connected to the driving circuit 120. For example, a portion to which a second connection wire 122, formed from a conductive wire such as a bonding wire or the like, is connected corresponds to the connection region 115. Meanwhile, the portion of the interconnect pattern 110 that is interposed between the protective substrate 30 and the sealing substrate 40 through the adhesive 46 is called a covered portion 113. Furthermore, the portion of the interconnect pattern 110 that is not covered by the protective substrate 30 and the sealing substrate 40 through the adhesive 46, and to which the external wiring 9*a* is connected, is called an external wiring connection portion 111.

In this embodiment, the plurality of interconnect patterns 110 are distinguished by shape and position, such that three types of interconnect patterns 110A, 110B, and 110C are provided on the protective substrate 30. Both ends of each interconnect pattern 110 are covered by neither the protective substrate 30 nor the sealing substrate 40, and the end portions thereof serve as the external wiring connection portion 111 and the connection portion 112, respectively. Note that the reference numerals 110A, 110B, and 110C will be used when describing the interconnect pattern 110A to the interconnect pattern 110C individually, whereas the reference numeral 110 will be used when referring to the interconnect patterns 110 collectively.

The interconnect pattern 110A is an interconnect for transmitting, to the driving circuit 120 via the second connection wire 122, a driving signal transmitted from the control device 9 via the external wiring 9*a* (not shown). Specifically, the external wiring 9*a* is connected to the external wiring connection portion 111 of the interconnect pattern 110A, and the second connection wire 122 is connected to the connection portion 112.

The interconnect pattern 110B is an interconnect for supplying a voltage (bias voltage) to be applied to the first electrode 60, which serves as the common electrode for the piezoelectric actuators 300. Specifically, the external wiring 9*a* is connected to the external wiring connection portion 111 of the interconnect pattern 110B, and a third connection wire 123, formed from a conductive wire such as a bonding wire or the like, is connected to the connection portion 112. The interconnect pattern 110B is connected to the first electrode 60 by the third connection wire 123.

The interconnect pattern 110C is an interconnect for transmitting a driving signal to the driving circuit 120, in the same manner as the interconnect pattern 110A. The interconnect pattern 110C is not interposed between the protective substrate 30 and the sealing substrate 40, but is covered by the driving circuit 120, and the external wiring connection portion 111 and connection portion 112 thereof are connected to the external wiring 9*a* and the driving circuit 120.

A groove 114 is formed between a border 140, between the bonding region 130 and the connection portion 112, and the connection region 115, in the connection portion 112 of the interconnect pattern 110A. The border 140 refers to a border line portion between the bonding region 130 and the connection portion 112 when the sealing substrate 40 is viewed in plan view (see FIGS. 6 and 8). In other words, this is a portion where, when viewed in plan view, a rim of the first opening 45 in the sealing substrate 40 and the interconnect pattern 110 overlap.

In this embodiment, the groove 114 is formed having a substantially rectangular shape so as to partially surround the connection region 115, and is conductive with the connection portion 112 on the opposite side of the connection region 115 from the border 140. In other words, the groove 114 is formed so that a region R of the connection region 115 not surrounded by the groove 114 is located on the opposite side from the border 140.

Note that the groove 114 being formed so as to partially surround the connection region 115 refers to the connection region 115 being formed so as to not be completely cut off from the connection portion 112 by the groove 114. However, the position of the region R that makes the connection region 115 and the connection portion 112 conductive is not limited to the side of the connection region 115 opposite from the border 140.

As described above, the sealing substrate 40 is bonded to the installation surface 301 of the protective substrate 30 and the covered portion 113 that is part of the interconnect pattern 110A using the adhesive 46. As such, it is possible that the adhesive 46 will leak from between the covered portion 113 and the sealing substrate 40 and advance along on the connection portion 112 toward the connection region 115 from the border 140, as indicated by an arrow P in FIG. 8. The adhesive 46 becomes less viscous in the case where the adhesive 46 is kept at a higher temperature than normal temperature in the process for bonding the sealing substrate 40 to the protective substrate 30, and thus the adhesive 46 can reach the connection region 115 with particular ease in such cases.

It is also possible that the adhesive 46 will leak from between the installation surface 301 of the protective substrate 30 and the sealing substrate 40 and progress along the peripheral edges of the connection portion 112, and then overflow onto the upper surface of the connection portion 112 after surrounding the entire periphery of the connection portion 112, as indicated by an arrow Q in FIG. 8.

However, the groove 114 is formed in the connection portion 112 in the interconnect pattern 110A according to this embodiment, and thus a set amount of the adhesive 46 can be held in the groove 114. Accordingly, even if the adhesive 46 has advanced onto the connection portion 112, the adhesive 46 can be stopped by the groove 114, and the adhesive 46 can be suppressed from reaching the connection region 115. Furthermore, even in the case where the adhesive 46 that has progressed along the peripheral edges of the connection portion 112 has overflowed onto the upper surface of the connection portion 112, the adhesive 46 flows into the groove 114, which makes it possible to suppress the adhesive 46 from reaching the connection region 115.

As described above, the connection region 115 has the region R, which is not surrounded by the groove 114, so that the connection region 115 and the connection portion 112 are conductive. Accordingly, there is a risk that the adhesive 46 will enter into the connection region 115 from the region R.

However, the region R is provided on the side of the connection region 115 opposite from the border 140, and is thus disposed in the position where the adhesive 46 is least likely to reach. That is, although it is conceivable that the adhesive 46 will follow a path that progresses along the peripheral edges of the connection portion 112, reaches the side opposite from the border 140, runs up onto the upper surface of the connection portion 112, and reaches the region R as indicated by the arrow Q, this path from the border 140 to the region R can be made the longest.

As described thus far, according to the invention, providing the groove 114 in the connection portion 112 of the interconnect pattern 110A makes it possible to suppress the adhesive 46 for bonding the sealing substrate 40 from entering into the connection region 115. Accordingly, the connection between the second connection wire 122 and the connection region 115 can be suppressed from being interfered with by the adhesive 46. Through this, the driving signals can be supplied to the driving circuit 120 across a secure connection between the second connection wire 122 and the connection region 115, and thus a recording head 220 capable of reliably ejecting ink is provided.

In addition, in the recording head 220 according to the invention, the sealing substrate 40 is bonded to the installation surface 301 of the protective substrate 30 and part of the interconnect patterns 110 using the adhesive 46. In other words, the interconnect patterns 110 (the interconnect pattern 110A and the interconnect pattern 110B, in this embodiment) are partially used as the bonding region to which the sealing substrate 40 is bonded.

For example, in this embodiment, the covered portions 113 of the interconnect pattern 110A and the interconnect pattern 110B serve as the bonding region, as illustrated in FIG. 6.

Because part of the interconnect patterns 110 also function as the bonding region, the overall bonding region of the installation surface 301 can be made narrower than in the case where part of the interconnect patterns 110 do not also function as the bonding region. In this manner, with the recording head 220 according to this embodiment, the bonding region of the protective substrate 30 can be reduced in size and made smaller in the planar direction (an XY plane). In the case where the interconnect patterns 110 do not also function as the bonding region, it is necessary to ensure a wide region between the first opening 45 and the second opening 43, for example, where the interconnect patterns 110 are not provided. Thus it is necessary to ensure a wider bonding region where the interconnect patterns 110 are not provided in the installation surface 301, which increases the size of the protective substrate 30.

Although the groove 114 is provided so as to partially surround the connection region 115 of the connection portion 112 in the recording head 220 according to this embodiment, the groove 114 is not limited to this form. It is sufficient for the groove 114 to be provided at least between the border 140 and the connection region 115. For example, the groove 114 may be provided between the border 140 of the connection portion 112 and the connection region 115 such that the connection portion 112 is not completely cut off. The groove 114 can stop the adhesive 46 from advancing into the connection region 115 from the border 140 in this case as well. Moreover, the number, shape, position, and so on of the groove 114 are not particularly limited, and any desired number, shape, and position may be employed. Furthermore, the groove 114 may be provided passing through the connection portion 112 in the thickness direction thereof, or not passing through.

Second Embodiment

Figure 10A:
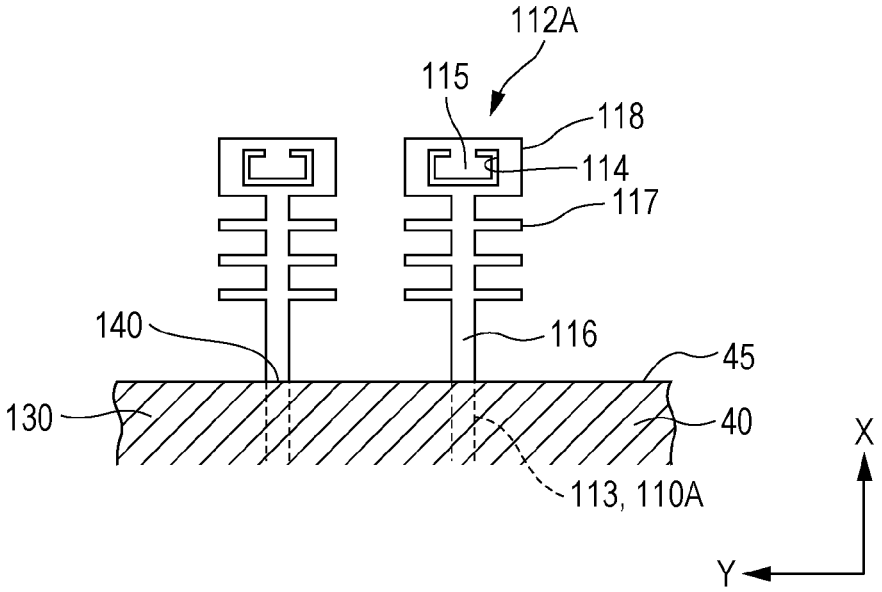
FIGS. 10A and 10B are plan views illustrating the enlarged vicinity of a connection portion of an interconnect pattern.
Figure 10B:
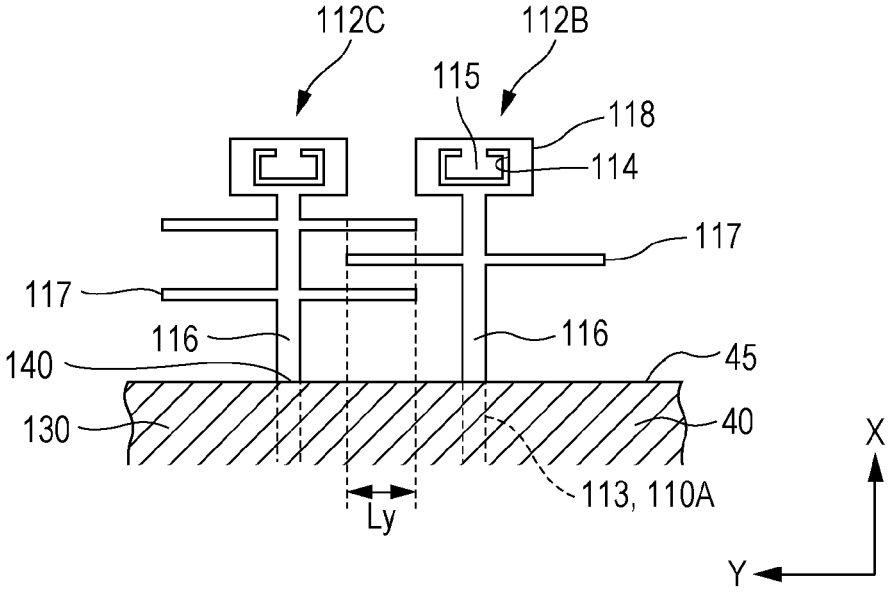

Although the recording head 220 according to the first embodiment suppresses the adhesive 46 from advancing into the connection region 115 by providing the groove 114 in the connection portion 112, the recording head is not limited thereto. FIGS. 10A and 10B are plan views of the vicinity of a connection portion of an interconnect pattern according to this embodiment. Note that elements identical to those in the first embodiment are given the same reference numerals, and redundant descriptions thereof will be omitted.

As illustrated in FIG. 10A, a connection portion 112A of the interconnect pattern 110A according to this embodiment includes a linear portion 116 provided between the border 140 and the connection region 115, branching portions 117 that branch off from the linear portion 116, and the connection region 115 partially surrounded by the groove 114. A portion constituted by the groove 114 and the connection region 115 will be called a connection main body portion 118. The connection main body portion 118 according to this embodiment is a rectangular portion of the interconnect pattern 110A that continues from the linear portion 116 on the side thereof opposite from the border 140.

The branching portions 117 extend from the linear portion 116, protruding in the planar direction (the XY planar direction). In this embodiment, a total of six branching portions 117, namely three on each of the left and right sides of the linear portion 116, are provided along the second direction Y, which is orthogonal to the first direction X in which the linear portion 116 extends.

Here, an advancement path along which the adhesive 46 that has leaked from the border 140 side advances follows the peripheral edges of the linear portion 116 and the branching portions 117, which are the peripheral edges of the connection portion 112A, reaches the connection main body portion 118, surrounds all of the peripheral edges of the linear portion 116, the branching portions 117, and the connection main body portion 118, runs up onto the upper surface of the connection main body portion 118, and then reaches the connection region 115.

Providing the branching portions 117 makes it possible to extend the length of the advancement path along which the adhesive 46 advances by an amount equivalent to the length of the peripheral edges of the branching portions 117. Because the advancement path can be extended in this manner, it is less likely that the adhesive 46 will surround all the peripheral edges of the linear portion 116, the branching portions 117, and the connection main body portion 118, which makes it possible to suppress the adhesive 46 from reaching the connection region 115.

Thus by providing the branching portions 117 in this manner, a situation in which the adhesive 46 reaches the connection region 115 and interferes with the connection with the second connection wire 122 can be avoided with more certainty.

FIG. 10B illustrates a connection portion 112B and a connection portion 112C that are adjacent to each other. The one connection portion 112B is provided with a total of two branching portions 117, namely one on each of the left and right sides of the linear portion 116. The other connection portion 112C, meanwhile, is provided with a total of four branching portions 117, namely two on each of the left and right sides of the linear portion 116.

In the connection portion 112B and the connection portion 112C that are adjacent to each other, one branching portion 117 of the connection portion 112B and the other branching portions 117 of the connection portion 112C overlap in the first direction X progressing from the border 140 toward the connection region 115. In other words, the branching portions 117 of the connection portion 112B and the connection portion 112C that are adjacent to each other are disposed in a range Ly in the second direction Y. It is sufficient for at least part of the branching portions 117 to be within the range Ly, but the branching portions 117 may be entirely within the range Ly as well.

Like the connection portion 112A illustrated in FIG. 10A, the connection portion 112B and the connection portion 112C configured having the branching portions 117 with such shapes make it possible to avoid a situation in which the adhesive 46 reaches the connection region 115 and interferes with the connection with the second connection wire 122.

Furthermore, the branching portion 117 of the one connection portion 112B overlaps with the branching portions 117 of the other connection portion 112C in the first direction X. In other words, the width taken up by the branching portions 117 in the second direction Y can be reduced by an amount equivalent to the range Ly in which the branching portions 117 overlap. In this manner, the width taken up by the connection portion 112B and the connection portion 112C in the second direction Y can be reduced, which makes it possible to reduce the size, in the planar direction, of the protective substrate 30 in which those portions are provided, and furthermore makes it possible to reduce the size of the recording head 220.

Although the branching portions 117 extend linearly along the second direction Y, the branching portions 117 are not limited to this form. The branching portions 117 may be any shape that branches from the linear portion 116, and thus the directions, shapes, and so on are not particularly limited.

In the recording head 220 according to the first embodiment, the piezoelectric actuators 300 provided in the flow channel formation substrate 10 are housed within the holding portion 32 provided in the protective substrate 30. In other words, the protective substrate 30 in which the interconnect patterns 110 are provided also functions as a member that protects the piezoelectric actuators 300. Accordingly, a separate member for protecting the piezoelectric actuators 300 is unnecessary, which makes it possible to reduce component costs. Note, however, that the invention is not limited to a configuration in which the protective substrate 30 in which the interconnect patterns 110 are provided also serves to protect the piezoelectric actuators 300. For example, a separate member for protecting the piezoelectric actuators 300 may be provided in the flow channel formation substrate 10 and the protective substrate 30 may be provided on that member.

Other Embodiments

Although embodiments of the invention have been described thus far, the invention is not intended to be limited to the basic configuration described above.

For example, although the groove 114 and the branching portions 117 are provided in the connection portion 112 in the second embodiment, the invention is not limited to such a configuration. For example, the interconnect patterns 110 may have the branching portions 117 and not have the groove 114. Even with such a configuration, the adhesive 46 can be suppressed from progressing along the peripheral edges of the connection portion 112 and reaching the connection region 115.

Although the first embodiment describes three examples of the interconnect pattern 110, namely the interconnect pattern 110A to the interconnect pattern 110C, based on their applications, positions, and so on, the interconnect patterns 110 are not limited to such applications, positions, and so on.

Although the first embodiment describes providing two driving circuits 120 for the two columns of piezoelectric actuators 300, the invention is not limited thereto. For example, a single common driving circuit 120 may be provided for the two columns of piezoelectric actuators 300.

Although the aforementioned first and second embodiments describe a configuration in which two columns of the piezoelectric actuators 300 are provided in the second direction Y as an example, the number of columns of piezoelectric actuators 300 is not particularly limited thereto, and three or more columns may be provided.

Although thin-film type piezoelectric actuators 300 are described as being used as the pressure generating units that cause pressure changes in the pressure generation chambers 12 in the aforementioned first and second embodiments, the invention is not particularly limited thereto; for example, a thick-film piezoelectric actuator formed through a method such as applying a green sheet, a longitudinally-vibrating piezoelectric actuator that extends and contracts in the axial direction, formed by alternately layering piezoelectric material and electrode formation material, and so on can be used as well. Moreover, a device in which thermal elements are disposed within the pressure generation chambers and liquid is discharged from the nozzle openings due to bubbles forming as a result of the heat from the thermal elements, a so-called electrostatic actuator that generates static electricity between a vibration plate and an electrode, with the resulting electrostatic force causing the vibration plate to distort and liquid to be discharged from the nozzle openings, and so on can also be used as the pressure generating units.

Although the sealing substrate 40 according to the first embodiment includes the second opening 43, the configuration is not limited thereto, and it is sufficient for at least the first opening 45 to be provided. In addition, the first opening 45 of the sealing substrate 40 is not limited to being formed by the frame-shaped anchoring plate 42. An "opening" in the sealing substrate as described in the aspects of the invention refers to a portion of an interconnect pattern, a driving circuit, or the like formed on the protective substrate that is not covered by the sealing substrate. For example, the sealing substrate may have a plate shape. A configuration in which such a plate-shaped sealing substrate is affixed to the installation surface of the protective substrate using an adhesive and a driving circuit, a connection portion of an interconnect pattern, or the like is exposed in a portion of the protective substrate to which the sealing substrate is not bonded also falls within the scope of the invention.

The first embodiment describes an example in which the recording heads 220 of the ink jet recording apparatus I are mounted in the carriage 3 as a head unit 1 and move in a main scanning direction, but the invention is not particularly limited thereto. For example, the invention can also be applied in what is known as a line-type recording apparatus, in which the head unit 1 is fixed, and printing is carried out simply by moving the ejection target medium S, such as paper, in a sub scanning direction.

Although the ink jet recording apparatus I according to the first embodiment is described as including the head unit 1 in which a plurality of recording heads 220 are mounted, the invention is not limited to such a configuration. The configuration may be such that a single recording head 220 is mounted in the carriage 3.

In addition, although the aforementioned examples describe the ink jet recording apparatus I as having a configuration in which the liquid holding units 2 such as ink tanks are fixed in the apparatus main body 4, and the holding units and the head unit 1 are connected by a supply pipe such as a tube or the like, the invention is not limited to such a configuration. For example, the configuration may be such that the liquid holding units 2 are mounted in the carriage 3.

The invention is generally applicable in all liquid ejecting heads, and can be applied in, for example, recording heads such as various types of ink jet recording heads used in image recording apparatuses such as printers, color material ejecting heads used in the manufacture of color filters for liquid crystal displays and the like, electrode material ejecting heads used to form electrodes for organic EL displays, FEDs (field emission displays), and the like, bioorganic matter ejecting heads used in the manufacture of biochips and the like, and so on.

In addition, the invention is generally applicable in all MEMS devices, and can also be applied in MEMS devices aside from liquid ejecting heads. Ultrasound devices, motors, pressure sensors, pyroelectric devices, ferroelectric devices, and so on can be given as examples of such MEMS devices. A complete device that uses such a MEMS device, such as an apparatus that ejects a liquid or the like using the aforementioned head, an ultrasound sensor that uses the aforementioned ultrasound device, a robot that uses the aforementioned motor as a drive source, an IR sensor that uses the aforementioned pyroelectric device, a ferroelectric memory that uses the aforementioned ferroelectric device, or the like also falls within the scope of the stated MEMS device.

CROSS-REFERENCE TO RELATED APPLICATIONS

The present application claims priority to Japanese Patent Application No. 2015-051211 filed on Mar. 13, 2015, which is hereby incorporated by reference in its entirety.

What is claimed is:

1. A MEMS device comprising:

a protective substrate on which is mounted a driving circuit that drives a pressure generating unit and on which is formed an interconnect pattern electrically connected to the driving circuit; and a sealing substrate that includes an opening and that is bonded to the protective substrate using an adhesive so that part of the interconnect pattern is located between the protective substrate and the sealing substrate, wherein the interconnect pattern includes a connection portion that extends from a region where the protective substrate and the sealing substrate are bonded by the adhesive to the opening, and that has a connection region electrically connected to the driving circuit; and a groove is formed in the connection portion between the connection region and a border between the region and the connection portion, wherein the groove is formed so as to partially surround the connection region and be conductive with the connection portion on the side of the connection region opposite from the border.

2. A liquid ejecting head comprising:

the MEMS device according to claim 1; and a flow channel formation substrate in which a pressure generation chamber that communicates with a nozzle opening that ejects a liquid is provided, wherein the pressure generating unit is provided on one surface of the flow channel formation substrate and generates a change in pressure in the liquid in the pressure generation chamber.

3. The liquid ejecting head according to claim 2, wherein the protective substrate is provided on the one surface of the flow channel formation substrate, and a space that allows the pressure generating unit to bend is formed in the protective substrate.

4. A liquid ejecting apparatus comprising the liquid ejecting head according to claim 2.

5. A MEMS device comprising:

a protective substrate on which is mounted a driving circuit that drives a pressure generating unit and on which is formed an interconnect pattern electrically connected to the driving circuit; and a sealing substrate that includes an opening and that is bonded to the protective substrate using an adhesive so that part of the interconnect pattern is located between the protective substrate and the sealing substrate, wherein the interconnect pattern includes a connection portion that extends from a region where the protective substrate and the sealing substrate are bonded by the adhesive to the opening, and that has a connection region electrically connected to the driving circuit; and a groove is formed in the connection portion between the connection region and a border between the region and the connection portion, wherein the connection portion has a linear portion provided between the border and the connection region, and a branching portion that branches from the linear portion.

6. The MEMS device according to claim 5, wherein in the adjacent connection portions, the branching portion of one of the connection portions and the branching portion of another of the connection portions overlap in a direction progressing from the border toward the connection region.

7. A liquid ejecting head comprising:

the MEMS device according to claim 6; and a flow channel formation substrate in which a pressure generation chamber that communicates with a nozzle opening that ejects a liquid is provided, wherein the pressure generating unit is provided on one surface of the flow channel formation substrate and generates a change in pressure in the liquid in the pressure generation chamber.

8. The liquid ejecting head according to claim 7, wherein the protective substrate is provided on the one surface of the flow channel formation substrate, and a space that allows the pressure generating unit to bend is formed in the protective substrate.

9. A liquid ejecting apparatus comprising the liquid ejecting head according to claim 7.

10. A liquid ejecting head comprising:

the MEMS device according to claim 5; and a flow channel formation substrate in which a pressure generation chamber that communicates with a nozzle opening that ejects a liquid is provided, wherein the pressure generating unit is provided on one surface of the flow channel formation substrate and generates a change in pressure in the liquid in the pressure generation chamber.

11. The liquid ejecting head according to claim 10, wherein the protective substrate is provided on the one surface of the flow channel formation substrate, and a space that allows the pressure generating unit to bend is formed in the protective substrate.

12. A liquid ejecting apparatus comprising the liquid ejecting head according to claim 10.

13. A MEMS device comprising:

a first substrate on which is mounted a driving circuit that drives a pressure generating unit and on a one side of which is formed an interconnect pattern electrically connected to the driving circuit; and a second substrate that includes an opening and that is bonded to the one side of the first substrate using an adhesive so that part of the interconnect pattern is interposed between the first substrate and the second substrate, wherein the interconnect pattern includes a connection portion that extends from a region where the first substrate and the second substrate are bonded by the adhesive to the opening, and that has a connection region electrically connected to the driving circuit; and a groove is formed in the connection portion between the connection region and a border between the region and the connection portion.

* * * * *